US011341927B2

(12) United States Patent
Wang

(10) Patent No.: US 11,341,927 B2
(45) Date of Patent: May 24, 2022

(54) PIXEL DRIVING METHOD

(71) Applicant: TCL CHINA STAR OPTOELECTRONICS TECHNOLOGY CO., LTD., Shenzhen (CN)

(72) Inventor: Geng Wang, Guangdong (CN)

(73) Assignee: TCL CHINA STAR OPTOELECTRONICS TECHNOLOGY CO., LTD., Guangdong (CN)

( * ) Notice: Subject to any disclaimer, the term of this patent is extended or adjusted under 35 U.S.C. 154(b) by 279 days.

(21) Appl. No.: 16/617,159

(22) PCT Filed: Jun. 25, 2019

(86) PCT No.: PCT/CN2019/092717

§ 371 (c)(1),
(2) Date: Nov. 26, 2019

(87) PCT Pub. No.: WO2020/228101

PCT Pub. Date: Nov. 19, 2020

(65) Prior Publication Data

US 2022/0005425 A1 Jan. 6, 2022

(30) Foreign Application Priority Data

May 10, 2019 (CN) ..... 201910390509.4

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01); *G09G 2300/0452* (2013.01); *G09G 2360/16* (2013.01)

(58) Field of Classification Search
CPC .. G09G 3/3607; G09G 3/3611; G09G 3/3677; G09G 3/3688; G09G 2300/0452; G09G 2360/16
See application file for complete search history.

(56) References Cited

U.S. PATENT DOCUMENTS

2013/0169619 A1* 7/2013 Jeong ..... G09G 3/3696 345/212
2021/0201841 A1* 7/2021 Shan ..... G09G 3/2003

* cited by examiner

*Primary Examiner* — Dennis P Joseph
(74) *Attorney, Agent, or Firm* — Benesch, Friedlander, Coplan & Aronoff LLP

(57) ABSTRACT

A pixel driving method is provided. Based on current brightness values of the sub-pixel in row j and column i, current brightness values of the sub-pixels that have the same color and are adjacent to the sub-pixel in row j and column i to obtain the target brightness value of the sub-pixel in row j and column i by the target brightness value calculation formula, and then to obtain a brightness compensation value of the sub-pixel in row j and column i by a brightness compensation value calculation formula, and based on the target brightness value of the sub-pixel in row j and column i, the brightness compensation value of the sub-pixel in row j and column i to output a compensated brightness value of the sub-pixel in row j and column i by a compensated brightness value calculation formula.

9 Claims, 3 Drawing Sheets

PIXEL DRIVING METHOD

FIELD OF INVENTION

The present disclosure relates to a display technology field, and in particular, relates to a pixel driving method.

BACKGROUND OF INVENTION

Thin film transistors (TFTs) are main driving components of liquid crystal displays (LCDs) and active matrix organic light-emitting diodes (AMOLEDs). They are directly related to display performance of a flat panel display device.

Most of the liquid crystal displays in the current market are backlight type liquid crystal displays, which include a liquid crystal display panel and a backlight module. The working principle of the liquid crystal display panel is to fill liquid crystal molecules between a thin film transistor array substrate (TFT array substrate) and a color filter (CF) substrate, and a pixel voltage and a common voltage are applied on the two substrates, respectively. Rotation direction of the liquid crystal molecules is controlled by an electric field formed between the pixel voltage and the common voltage to transmit light of the backlight module to display.

Currently, in order to further promote the popularity of LCD TVs, LCD panels continue to pursue low cost and high quality. In order to reduce costs, dual-gate structure display panel becomes an effective solution. Referring to FIG. 1, the dual-gate structure display panel includes a plurality of sub-pixels 10' arranged in an array, a plurality of scanning lines 20' extending in a horizontal direction, and a plurality of data lines 30' extending in a vertical direction. Every two scanning lines 20' connects to a row of sub-pixels 10'. Two adjacent columns of sub-pixels 10' respectively connect to data lines 30' adjacent left and right t0 the two adjacent columns of sub-pixels 10'. Therefore, the dual-gate structure display panel can greatly reduce the number of source drivers (such as four data lines 30' can be connected to six columns of sub-pixels 10'), thereby reducing the cost of the liquid crystal panel.

Although the dual-gate structure display panel achieves cost reduction by reducing the number of source drivers, the scanning speed of the display panel has doubled. A faster scan speed will inevitably lead to an increase in the driver IC loading, especially under the overload display screen (such as all red and blue sub-pixels have a gray scale of 0, all green sub-pixels have a gray scale of 255). The source driver that is too hot can be dangerous, causing irreversible damage to the source driver, making it impossible to operate properly. At present, the problem of excessive temperature of the source driver under the overload display screen is solved mainly by adding a heat sink. However, the increase in heat sinks undoubtedly lead to an increase in cost.

SUMMARY OF INVENTION

An object of the present disclosure is to provide a pixel driving method.

To achieve the above objects, the present disclosure provides a pixel driving method, wherein the pixel driving method includes steps of step S1, providing a pixel driving circuit, wherein the pixel driving circuit includes a plurality of sub-pixel groups arranged in an array, each of the sub-pixel groups includes two sub-pixels, and the sub-pixels are arranged in an array; step S2, based on current brightness values of the sub-pixel in row j and column i, and current brightness values of the sub-pixels that have the same color and are adjacent to the sub-pixel in row j and column i, obtaining a target brightness value of the sub-pixel in row j and column i by a target brightness value calculation formula; step S3, obtaining a brightness compensation value of the sub-pixel in row j and column i by a brightness compensation value calculation formula; step S4, based on the target brightness value of the sub-pixel in row j and column i and the brightness compensation value of the sub-pixel in row j and column i, outputting a compensated brightness value of the sub-pixel in row j and column i by a compensated brightness value calculation formula; and step S5, repeating step S2 to step S4 until the compensated brightness values of all sub-pixels are output.

In one embodiment of the present disclosure, the pixel driving circuit further includes a plurality of scanning lines extending in a horizontal direction and a plurality of data lines extending in a vertical direction; the two sub-pixels of each of the sub-pixel groups are arranged in the horizontal direction, and every two scanning lines connects to a row of sub-pixels, wherein one of the two scanning lines connects to the sub-pixel located at an odd-numbered column in the row of the sub-pixels, the other scanning line connects to the sub-pixel located at an even-numbered column in the row of the sub-pixels; the sub-pixel groups in each column are alternately connected to the data lines that are adjacent left and right to the column of sub-pixel groups.

In one embodiment of the present disclosure, the sub-pixels in each column are sub-pixels that have the same color; three adjacent sub-pixels in each row of the sub-pixels are a red sub-pixel, a green sub-pixel, and a blue sub-pixel.

In one embodiment of the present disclosure, in the step S2, the target brightness value calculation formula is as follows:

$$T_{M_{j,i}}=(M_{j,i}+M_{j+1,i}+M_{j,i+3}+M_{j+1,i+3})/4$$

Wherein $T_{M_{j,i}}$ is the target brightness value of the sub-pixel in row j and column i;

Wherein $M_{j,i}$ is the current brightness value of the sub-pixel in row j and column i;

Wherein $M_{j+1,i}$ is the current brightness value of the sub-pixel in row j+1 and column i;

Wherein $M_{j,i+3}$ is the current brightness value of the sub-pixel in row j and column i+3;

Wherein $M_{j+1,i+3}$ is the current brightness value of the sub-pixel in row j+1 and column i+3.

In one embodiment of the present disclosure, in the step S3, based on a difference between the current brightness values of the sub-pixels connected to the data lines that are adjacent left and right to the sub-pixel in row j and column i and a difference between the current brightness value of the sub-pixel in row j and column i and the current brightness value of the sub-pixel located in row j and connected to the same data line as the sub-pixel in row j and column i, obtaining the brightness compensation value of the sub-pixel in row j and column i by the brightness compensation value calculation formula.

In one embodiment of the present disclosure, in the step S3, the brightness compensation value calculation formula is as follows:

$$\Delta_{j,i}=\frac{\sum_{n=1}^{10}\Delta_n}{10};$$

Wherein $\Delta_{j,i}$ is the brightness compensation value of the sub-pixel in row j and column i;

Wherein $\Delta_1=|M_{j,i}-M_{j,i+1}|$, $\Delta_2=|M_{j,i+1}-M_{j+,i-2}|$, $\Delta_3=|M_{j+1,i-2}-M_{j+1,i-1}|$, $\Delta_4=|M_{j+1,i-1}-M_{j+2,i}|$, $\Delta_5=|M_{j+2,i}-M_{j+2,i+1}|$, $\Delta_6=|M_{j,i+2}-M_{j,i+3}|$, $\Delta_7=|M_{j,i+3}-M_{j+1,i}|$, $\Delta_8=|M_{j+1,i}-M_{j+1,i+1}|$, $\Delta_9=|M_{j+1,i+1}-M_{j+2,i+2}|$, $\Delta_{10}=|M_{j+2,i+2}-M_{j+2,i+3}|$;

Wherein $M_{j,i}$ is the current brightness value of the sub-pixel in row j and column i;

Wherein $M_{j,i+1}$ is the current brightness value of the sub-pixel in row j and column i+1;

Wherein $M_{j+1,i-2}$ is the current brightness value of the sub-pixel in row j+1 and column i−2;

Wherein $M_{j+1,i-1}$ is the current brightness value of the sub-pixel in row j+1 and column i−1;

Wherein $M_{j+2,i}$ is the current brightness value of the sub-pixel in row j+2 and column i;

Wherein $M_{j+2,i+1}$ is the current brightness value of the sub-pixel in row j+2 and column i+1;

Wherein $M_{j,i+2}$ is the current brightness value of the sub-pixel in row j and column i+2;

Wherein $M_{j,i+3}$ is the current brightness value of the sub-pixel in row j and column i+3;

Wherein $M_{j+1,i}$ is the current brightness value of the sub-pixel in row j+1 and column i;

Wherein $M_{j+1,i+1}$ is the current brightness value of the sub-pixel in row j+1 and column i+1;

Wherein $M_{j+2,i+2}$ is the current brightness value of the sub-pixel in row j+2 and column i+2;

Wherein $M_{j+2,i+3}$ is the current brightness value of the sub-pixel in row j+2 and column i+3.

In one embodiment of the present disclosure, i is 1 or 2, $M_{j+1,i-2}$ is replaced by $M_{j+1,i+4}$;

$M_{j+1,i-1}$ is replaced by $M_{j+1,i+5}$;

Wherein $M_{j+1,i+4}$ is the current brightness value of the sub-pixel in row j+1 and column i+4;

Wherein $M_{j+1,i+5}$ is the current brightness value of the sub-pixel in row j+1 and column i+5.

In one embodiment of the present disclosure, in the step S4, the compensated brightness value calculation formula is as follows:

$$\text{New}M_{j,i}=M_{j,i}+\text{ratio}*|T_{M_{j,i}}-M_{j,i}|;$$

Wherein $\text{New}M_{j,i}$ is the compensated brightness value of the sub-pixel in row j and column i;

Wherein ratio is a compensation coefficient corresponding to the brightness compensation value of the sub-pixel in row j and column i.

In one embodiment of the present disclosure, in the step S5, a displayed image of an overload display screen is converted to a displayed image of a light-load display screen by outputting the compensated brightness value of all sub-pixels.

In one embodiment of the present disclosure, the overload display screen is defined as a display screen where the brightness value of the sub-pixel in column i is greater than or equal to a preset first brightness value, and the brightness value of the sub-pixel in column i+1 is less than or equal to a preset second brightness value, and the first brightness value is greater than the second brightness value.

In the advantageous effects of the present disclosure, in the pixel driving method of the present disclosure, based on current brightness values of the sub-pixel in row j and column i, current brightness values of the sub-pixels that have the same color and are adjacent to the sub-pixel in row j and column i to obtain the target brightness value of the sub-pixel in row j and column i by the target brightness value calculation formula, and then to obtain a brightness compensation value of the sub-pixel in row j and column i by a brightness compensation value calculation formula, and based on the target brightness value of the sub-pixel in row j and column i, the brightness compensation value of the sub-pixel in row j and column i to output a compensated brightness value of the sub-pixel in row j and column i by a compensated brightness value calculation formula. Thus, a displayed image of an overload display screen is converted to a displayed image of a light-load display screen, and the problem of excessive temperature of the source driver under the overload display screen is solved without increasing the cost.

DESCRIPTION OF DRAWINGS

In order to more clearly illustrate the embodiments or prior art technical solutions embodiment of the present disclosure, will implement the following figures for the cases described in prior art or require the use of a simple introduction. Obviously, the following description of the drawings are only some of those of ordinary skill in terms of creative effort without precondition, you can also obtain other drawings based on these drawings embodiments of the present disclosure.

DETAILED DESCRIPTION OF PREFERRED EMBODIMENTS

Structure and technical means adopted by the present disclosure to achieve the above and other objects can be best understood by referring to the following detailed description of the preferred embodiments and the accompanying drawings. Furthermore, directional terms described by the present disclosure, such as upper, lower, front, back, left, right, inner, outer, side, longitudinal/vertical, transverse/horizontal, etc., are only directions by referring to the accompanying drawings, and thus the used directional terms are used to describe and understand the present disclosure, but the present disclosure is not limited thereto.

Figure 1:
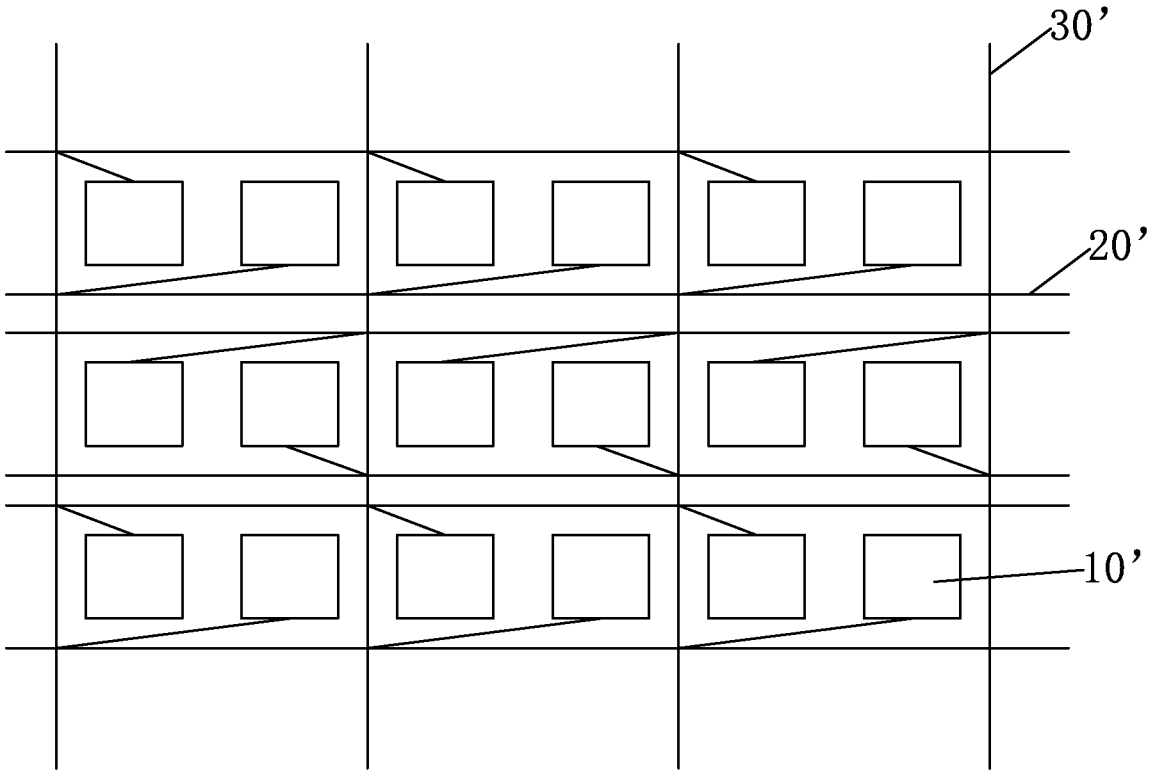
FIG. 1 is a schematic view of a conventional pixel driving circuit.
Figure 2:
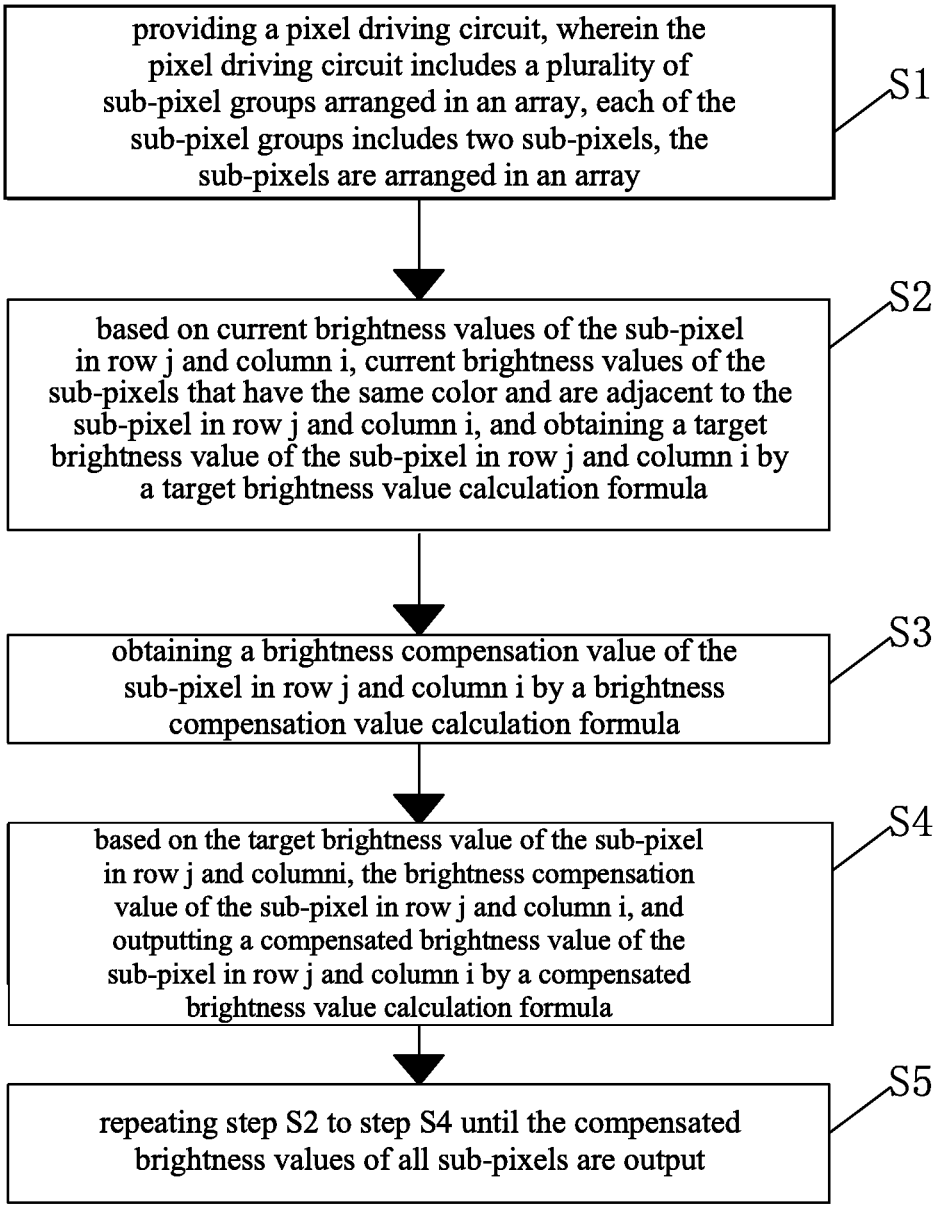
FIG. 2 is a flowchart of a pixel driving method according to the present disclosure.

Referring to FIG. 2, a flowchart of a pixel driving method according to the present disclosure is illustrated. The pixel driving method includes steps of step S1, step S2, and step S3.

Figure 3:
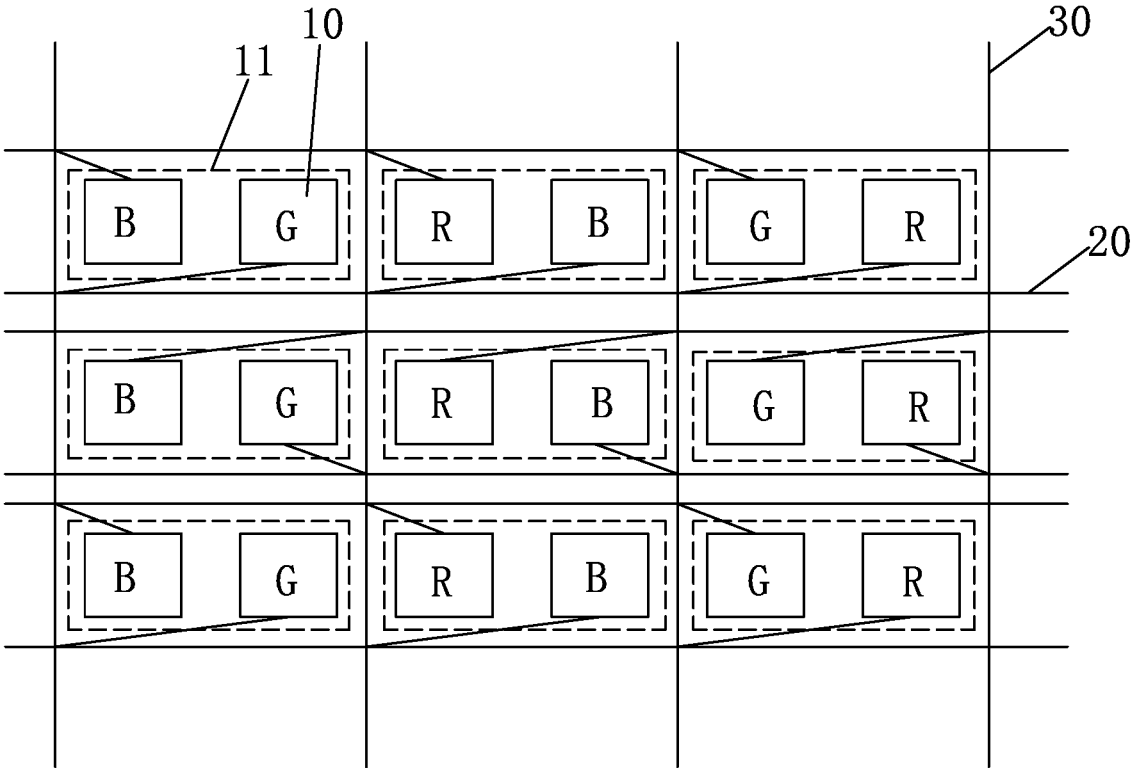
FIG. 3 is a schematic view of step S1 of the pixel driving method according to the present disclosure.

Referring to FIG. 3, in step S1, a pixel driving circuit is provided, wherein the pixel driving circuit includes a plurality of sub-pixel groups 11 arranged in an array, each of the sub-pixel groups includes two sub-pixels 10, and the sub-pixels 10 are arranged in an array.

In step S2, based on current brightness values of the sub-pixel 10 in row j and column i, current brightness values of the sub-pixels 10 that have the same color and are adjacent to the sub-pixel in row j and column i, and a target brightness value of the sub-pixel in row j and column i by a target brightness value calculation formula is obtained.

In step S3, a brightness compensation value of the sub-pixel 10 in row j and column i by a brightness compensation value calculation formula is obtained.

In step S4, based on the target brightness value of the sub-pixel 10 in row j and column i, the brightness compensation value of the sub-pixel in row j and column i, and a compensated brightness value of the sub-pixel in row j and column i by a compensated brightness value calculation formula is output.

In step S5, step S2 to step S4 are repeated until the compensated brightness values of all sub-pixels are output.

Shown in FIG. 3, specifically, the pixel driving circuit further includes a plurality of scanning lines 20 extending in a horizontal direction and a plurality of data lines 30 extending in a vertical direction. The two sub-pixels 10 of each of the sub-pixel groups 11 are arranged in the horizontal direction, and every two scanning lines 20 connects to a row of sub-pixels 10, wherein one of the two scanning lines 20 connects to the sub-pixel 10 located at an odd-numbered column in the row of the sub-pixels 10, the other scanning line 20 connects to the sub-pixel 10 located at an even-numbered column in the row of the sub-pixels 10. The sub-pixel groups 11 in each column are alternately connected to the data lines 30 that are adjacent left and right to the column of sub-pixel groups.

Specifically, the sub-pixels 10 in each column are sub-pixels 10 that have the same color, and three adjacent sub-pixels 10 in each row of the sub-pixels 10 are a red sub-pixel R, a green sub-pixel G, and a blue sub-pixel G. For example, the sub-pixel 10 in row 1 of the sub-pixels 10 is a red sub-pixel B, the sub-pixel 10 in row 2 of the sub-pixels 10 is a red sub-pixel G, the sub-pixel 10 in row 3 of the sub-pixels 10 is a red sub-pixel R, the sub-pixel 10 in row 4 of the sub-pixels 10 is a red sub-pixel B, and so on.

Specifically, in the step S2, the target brightness value calculation formula is as follows:

$$T_{M_{j,i}}=(M_{j,i}+M_{j+1,i}+M_{j,i+3}+M_{j+1,i+3})/4$$

Wherein $T_{M_{j,i}}$ is the target brightness value of the sub-pixel 10 in row j and column i.

Wherein $M_{j,i}$ is the current brightness value of the sub-pixel 10 in row j and column i.

Wherein $M_{j+1,i}$ is the current brightness value of the sub-pixel 10 in row j+1 and column i.

Wherein $M_{j,i+3}$ is the current brightness value of the sub-pixel 10 in row j and column i+3.

Wherein $M_{j+1,i+3}$ is the current brightness value of the sub-pixel 10 in row j+1 and column i+3.

Specifically, in the step S3, based on a difference between the current brightness values of the sub-pixels 10 connected to the data lines 30 that are adjacent left and right to the sub-pixel 10 in row j and column i and a difference between the current brightness value of the sub-pixel 10 in row j and column i and the current brightness value of the sub-pixel 10 located in row j and connected to the same data line 30 as the sub-pixel in row j and column i, the brightness compensation value of the sub-pixel 10 in row j and column i is obtained by the brightness compensation value calculation formula.

Further, in the step S3, the brightness compensation value calculation formula is as follows:

$$\Delta_{j,i}=\frac{\sum_{n=1}^{10}\Delta_n}{10};$$

Wherein $\Delta_{j,i}$ is the brightness compensation value of the sub-pixel 10 in row j and column i.

wherein $\Delta_1=|M_{j,i}-M_{j,i+1}|$, $\Delta_2=|M_{j,i+1}-M_{j+,i-2}|$, $\Delta_3=|M_{j+1,i-2}-M_{j+1,i-1}|$, $\Delta_4=|M_{j+1,i-1}-M_{j+2,i}|$, $\Delta_5=|M_{j+2,i}-M_{j+2,i+1}|$, $\Delta_6=|M_{j,i+2}-M_{j,i+3}|$, $\Delta_7=|M_{j,i+3}-M_{j+1,i}|$, $\Delta_8=|M_{j+1,i}-M_{j+1,i+1}|$, $\Delta_9=|M_{j+1,i+1}-M_{j+2,i+2}|$, $\Delta_{10}=|M_{j+2,i+2}-M_{j+2,i+3}|$.

Wherein $M_{j,i}$ is the current brightness value of the sub-pixel 10 in row j and column i.

Wherein $M_{j,i+1}$ is the current brightness value of the sub-pixel 10 in row j and column i+1.

Wherein $M_{j+1,i-2}$ is the current brightness value of the sub-pixel 10 in row j+1 and column i−2.

Wherein $M_{j+1,i-1}$ is the current brightness value of the sub-pixel 10 in row j+1 and column i−1.

Wherein $M_{j+2,i}$ is the current brightness value of the sub-pixel 10 in row j+2 and column i.

Wherein $M_{j+2,i+1}$ is the current brightness value of the sub-pixel 10 in row j+2 and column i+1.

wherein $M_{j,i+2}$ is the current brightness value of the sub-pixel 10 in row j and column i+2.

Wherein $M_{j,i+3}$ is the current brightness value of the sub-pixel 10 in row j and column i+3.

Wherein $M_{j+1,i}$ is the current brightness value of the sub-pixel 10 in row j+1 and column i.

Wherein $M_{j+1,i+1}$ is the current brightness value of the sub-pixel 10 in row j+1 and column i+1.

Wherein $M_{j+2,i+2}$ is the current brightness value of the sub-pixel 10 in row j+2 and column i+2.

Wherein $M_{j+2,i+3}$ is the current brightness value of the sub-pixel 10 in row j+2 and column i+3.

Further, when i is 1 or 2, $M_{j+1,i-2}$ is replaced by $M_{j+1,i+4}$.

$M_{j+1,i-1}$ is replaced by $M_{j+1,i+5}$.

Wherein $M_{j+1,i+4}$ is the current brightness value of the sub-pixel 10 in row j+1 and column i+4.

Wherein $M_{j+1,i+5}$ is the current brightness value of the sub-pixel 10 in row j+1 and column i+5.

Specifically, in the step S4, the compensated brightness value calculation formula is as follows:

$$\text{New}M_{j,i}=M_{j,i}+\text{ratio}*|T_{M_{j,i}}-M_{j,i}|$$

Wherein $\text{New}M_{j,i}$ is the compensated brightness value of the sub-pixel 10 in row j and column i.

Wherein ratio is a compensation coefficient corresponding to the brightness compensation value of the sub-pixel 10 in row j and column i.

Specifically, in the step S5, a displayed image of an overload display screen is converted to a displayed image of a light-load display screen by outputting the compensated brightness value of all sub-pixels 10.

Specifically, the overload display screen is defined as a display screen where the brightness value of the sub-pixel 10 in column i is greater than or equal to a preset first brightness value, and the brightness value of the sub-pixel 10 in column i+1 is less than or equal to a preset second brightness value, and the first brightness value is greater than the second brightness value.

Explanation through that the sub-pixel 10 in row 1 of the sub-pixels 10 is a red sub-pixel B, the sub-pixel 10 in row 2 of the sub-pixels 10 is a red sub-pixel G, the sub-pixel 10 in row 3 of the sub-pixels 10 is a red sub-pixel R, and the compensated brightness value of the sub-pixel 10 in row 1 and column 1 is output.

Frist, the target brightness value $T_{M_{1,1}}$ of the sub-pixel 10 in row 1 and column 1 is obtained by the target brightness value calculation formula:

$$T_{M_{1,1}}=(M_{1,1}+M_{2,1}+M_{1,4}+M_{2,4})/4;$$

The brightness compensation value $\Delta_{1,1}$ of the sub-pixel in row 1 and column 1 is obtained by a brightness compensation value calculation formula:

$$\Delta_{1,1} = \frac{\sum_{n=1}^{10} \Delta_n}{10};$$

Wherein $\Delta_1=|M_{1,1}-M_{1,2}|$, $\Delta_2=|M_{1,2}-M_{2,5}|$, $\Delta_3=|M_{2,5}-M_{2,6}|$, $\Delta_4=|M_{2,6}-M_{3,1}|$, $\Delta_5=|M_{3,1}-M_{3,2}|$, $\Delta_6=|M_{1,3}-M_{1,4}|$, $\Delta_7=|M_{1,4}-M_{2,1}|$, $\Delta_8=|M_{2,1}-M_{2,2}|$, $\Delta_9=|M_{2,2}-M_{3,3}|$, $\Delta_{10}=|M_{3,3}-M_{3,4}|$.

The brightness compensation value $NewM_{1,1}$ of the sub-pixel 10 in row 1 and column 1 is obtained by a brightness compensation value calculation formula:

$$NewM_{1,1}=M_{1,1}+ratio*|T_{M_{1,1}}-M_{1,1}|;$$

Said steps are repeated until the compensated brightness values of all sub-pixels 10 are output, and a displayed image of an overload display screen is converted to a displayed image of a light-load display screen. Thus, the problem of excessive temperature of the source driver under the overload display screen is solved without increasing the cost.

As the described above, in the pixel driving method of the present disclosure, based on current brightness values of the sub-pixel in row j and column i, current brightness values of the sub-pixels that have the same color and are adjacent to the sub-pixel in row j and column i to obtain the target brightness value of the sub-pixel in row j and column i by the target brightness value calculation formula, and then to obtain a brightness compensation value of the sub-pixel in row j and column i by a brightness compensation value calculation formula, and based on the target brightness value of the sub-pixel in row j and column i, the brightness compensation value of the sub-pixel in row j and column i to output a compensated brightness value of the sub-pixel in row j and column i by a compensated brightness value calculation formula. Thus, a displayed image of an overload display screen is converted to a displayed image of a light-load display screen, and the problem of excessive temperature of the source driver under the overload display screen is solved without increasing the cost.

The present disclosure has been described with preferred embodiments thereof and it is understood that many changes and modifications to the described embodiments can be carried out without departing from the scope and the spirit of the disclosure that is intended to be limited only by the appended claims.

What is claimed is:

1. A pixel driving method, comprising steps of:

step S1, providing a pixel driving circuit, wherein the pixel driving circuit includes a plurality of sub-pixel groups arranged in an array, each of the sub-pixel groups includes two sub-pixels, and the sub-pixels are arranged in an array;

step S2, based on current brightness values of the sub-pixel in row j and column i, current brightness values of the sub-pixels that have the same color and are adjacent to the sub-pixel in row j and column i, and obtaining a target brightness value of the sub-pixel in row j and column i by a target brightness value calculation formula, the target brightness value calculation formula is as follows:

$$T_{M_{j,i}}=(M_{j,i}+M_{j+1,i}+M_{j,i+3}+M_{j+1,i+3})/4;$$

wherein $T_{M_{j,i}}$ is the target brightness value of the sub-pixel in row j and column i;

wherein $M_{j,i}$ is the current brightness value of the sub-pixel in row j and column i;

wherein $M_{j+1,i}$ is the current brightness value of the sub-pixel in row j+1 and column i;

wherein $M_{j,i+3}$ is the current brightness value of the sub-pixel in row j and column i+3;

Wherein $M_{j+1,i+3}$ is the current brightness value of the sub-pixel in row j+1 and column i+3;

step S3, obtaining a brightness compensation value of the sub-pixel in row j and column i by a brightness compensation value calculation formula;

step S4, based on the target brightness value of the sub-pixel in row j and column i, the brightness compensation value of the sub-pixel in row j and column i, and outputting a compensated brightness value of the sub-pixel in row j and column i by a compensated brightness value calculation formula; and step S5, repeating step S2 to step S4 until the compensated brightness values of all sub-pixels are output.

2. The pixel driving method according to claim 1, wherein the pixel driving circuit further includes a plurality of scanning lines extending in a horizontal direction and a plurality of data lines extending in a vertical direction;

the two sub-pixels of each of the sub-pixel groups are arranged in the horizontal direction, and every two scanning lines connects to a row of sub-pixels, wherein one of the two scanning lines connects to the sub-pixel located at an odd-numbered column in the row of the sub-pixels, the other scanning line connects to the sub-pixel located at an even-numbered column in the row of the sub-pixels;

the sub-pixel groups in each column are alternately connected to the data lines that are adjacent left and right to the column of sub-pixel groups.

3. The pixel driving method according to claim 2, wherein the sub-pixels in each column are sub-pixels that have the same color;

three adjacent sub-pixels in each row of the sub-pixels are a red sub-pixel, a green sub-pixel, and a blue sub-pixel.

4. The pixel driving method according to claim 1, wherein in the step S3, based on a difference between the current brightness values of the sub-pixels connected to the data lines that are adjacent left and right to the sub-pixel in row j and column i and a difference between the current brightness value of the sub-pixel in row j and column i and the current brightness value of the sub-pixel located in row j and connected to the same data line as the sub-pixel in row j and column i, obtaining the brightness compensation value of the sub-pixel in row j and column i by the brightness compensation value calculation formula.

5. The pixel driving method according to claim 4, wherein in the step S3, the brightness compensation value calculation formula is as follows:

$$\Delta_{j,i} = \frac{\sum_{n=1}^{10} \Delta_n}{10};$$

wherein $\Delta_{j,i}$ is the brightness compensation value of the sub-pixel in row j and column i;

wherein $\Delta_1=|M_{j,i}-M_{j,i+1}|$, $\Delta_2=|M_{j,i+1}-M_{j+,i-2}|$, $\Delta_3=|M_{j+1,i-2}-M_{j+1,i-1}|$, $\Delta_4=|M_{j+1,i-1}-M_{j+2,i}|$, $\Delta_5=|M_{j+2,i}-$ $M_{j+2,i+1}|$, $\Delta_6=|M_{j,i+2}-M_{j,i+3}|$, $\Delta_7=|M_{j,i+3}-M_{j+1,i}|$, $\Delta_8=|M_{j+1,i}-M_{j+1,i+1}|$, $\Delta_9=|M_{j+1,i+1}-M_{j+2,i+2}|$, $\Delta_{10}=|M_{j+2,i+2}-M_{j+2,i+3}|$;

wherein $M_{j,i}$ is the current brightness value of the sub-pixel in row j and column i;

wherein $M_{j,i+1}$ is the current brightness value of the sub-pixel in row j and column i+1;

wherein $M_{j+1,i-2}$ is the current brightness value of the sub-pixel in row j+1 and column i−2;

wherein $M_{j+1,i-1}$ is the current brightness value of the sub-pixel in row j+1 and column i−1;

wherein $M_{j+2,i}$ is the current brightness value of the sub-pixel in row j+2 and column i;

wherein $M_{j+2,i+1}$ is the current brightness value of the sub-pixel in row j+2 and column i+1;

wherein $M_{j,i+2}$ is the current brightness value of the sub-pixel in row j and column i+2;

wherein $M_{j,i+3}$ is the current brightness value of the sub-pixel in row j and column i+3;

wherein $M_{j+1,i}$ is the current brightness value of the sub-pixel in row j+1 and column i;

wherein $M_{j+1,i+1}$ is the current brightness value of the sub-pixel in row j+1 and column i+1;

wherein $M_{j+2,i+2}$ is the current brightness value of the sub-pixel in row j+2 and column i+2;

wherein $M_{j+2,i+3}$ is the current brightness value of the sub-pixel in row j+2 and column i+3.

6. The pixel driving method according to claim 5, wherein when i is 1 or 2, $M_{j+1,i-2}$ is replaced by $M_{j+1,i+4}$;

$M_{j+1,i-1}$ is replaced by $M_{j+1,i+5}$;

wherein $M_{j+1,\ i+4}$ is the current brightness value of the sub-pixel in row j+1 and column i+4;

wherein $M_{j+1,\ i+5}$ is the current brightness value of the sub-pixel in row j+1 and column i+5.

7. The pixel driving method according to claim 5, wherein in the step S4, the compensated brightness value calculation formula is as follows:

$$\mathrm{New}M_{j,i}=M_{j,i}+\mathrm{ratio}*|T_{M_{j,i}}-M_{j,i}|;$$

wherein $\mathrm{New}M_{j,i}$ is the compensated brightness value of the sub-pixel in row j and column i;

wherein ratio is a compensation coefficient corresponding to the brightness compensation value of the sub-pixel in row j and column i.

8. The pixel driving method according to claim 1, wherein in the step S5, a displayed image of an overload display screen is converted to a displayed image of a light-load display screen by outputting the compensated brightness value of all sub-pixels.

9. The pixel driving method according to claim 8, wherein the overload display screen is defined as a display screen where the brightness value of the sub-pixel in column i is greater than or equal to a preset first brightness value, and the brightness value of the sub-pixel in column i+1 is less than or equal to a preset second brightness value, and the first brightness value is greater than the second brightness value.

* * * * *